US010123108B2

(12) United States Patent
Morris et al.

(10) Patent No.: US 10,123,108 B2
(45) Date of Patent: Nov. 6, 2018

(54) EARBUD ASSEMBLY WITH OVERMOLDED SEAM COVER

(71) Applicant: Oculus VR, LLC, Menlo Park, CA (US)

(72) Inventors: Quintin Morris, Issaquah, WA (US); James Stocker Webb, Seattle, WA (US); Mark Shintaro Ando, Seattle, WA (US); Peter Wesley Bristol, Seattle, WA (US); David Tao, Santa Clara, CA (US); Daniel James Faulkner, Portland, OR (US)

(73) Assignee: Oculus VR, LLC, Menlo Park, CA (US)

( * ) Notice: Subject to any disclaimer, the term of this patent is extended or adjusted under 35 U.S.C. 154(b) by 38 days.

(21) Appl. No.: 15/161,130

(22) Filed: May 20, 2016

(65) Prior Publication Data

US 2017/0195773 A1 Jul. 6, 2017

Related U.S. Application Data

(60) Provisional application No. 62/273,711, filed on Dec. 31, 2015.

(51) Int. Cl.
*H04R 1/10* (2006.01)

(52) U.S. Cl.
CPC ..... *H04R 1/1058* (2013.01); *H04R 1/1016* (2013.01); *H04R 1/1033* (2013.01); *H04R 1/1075* (2013.01); *H04R 2499/15* (2013.01)

(58) Field of Classification Search
CPC .. H04R 1/1058; H04R 1/1066; H04R 1/1075; H04R 2460/09; H04R 5/0335; H04R 1/02; H04R 1/1016
See application file for complete search history.

(56) References Cited

U.S. PATENT DOCUMENTS

| | | | | |
|---|---|---|---|---|
| 8,515,115 | B2 * | 8/2013 | Kelly | H04R 1/1016 381/370 |
| 8,971,561 | B2 * | 3/2015 | Howes | H04R 1/1016 381/370 |
| 9,113,254 | B2 * | 8/2015 | Cotha | H04R 1/1058 |
| 2011/0249856 | A1 * | 10/2011 | Takei | H04R 1/1016 381/380 |
| 2013/0343594 | A1 * | 12/2013 | Howes | H04R 1/1016 381/380 |
| 2014/0068944 | A1 * | 3/2014 | Aase | H04R 31/006 29/896.2 |

(Continued)

*Primary Examiner* — Fan Tsang
*Assistant Examiner* — Angelica M McKinney
(74) *Attorney, Agent, or Firm* — FisherBroyles, LLP

(57) ABSTRACT

An earbud assembly with separate, flexible overmold sections configured to cover a seam between adjacent portions of an underling earbud housing. The earbud assembly includes a first housing member and a second housing member attached to the first housing member and forming enclosure with the first housing member that houses an audio transducer. A first flexible overmold is formed on an first exterior surface of the first housing member, and a second flexible overmold is formed on an exterior surface of the second housing member. The flexible overmolds each include an edge portion along their perimeters. Each edge portion is configured to abut the other and thereby cover the seam of the earbud housing.

15 Claims, 7 Drawing Sheets

(56) References Cited

U.S. PATENT DOCUMENTS

| | | | | |
|---|---|---|---|---|
| 2015/0312672 | A1* | 10/2015 | Kurtz | H04R 1/1091<br>381/374 |
| 2016/0073192 | A1* | 3/2016 | Briggs | H04R 1/1058<br>381/380 |

* cited by examiner

EARBUD ASSEMBLY WITH OVERMOLDED SEAM COVER

CROSS-REFERENCE TO RELATED APPLICATION(S)

This application claims the benefit of U.S. Provisional Patent Application No. 62/273,711 filed Dec. 31, 2015 and titled EARBUD ASSEMBLY WITH OVERMOLDED SEAM COVER, which is incorporated herein by reference in its entirety.

TECHNICAL FIELD

This application relates generally to audio headphones, and in particular to earbud assemblies, including earbud assemblies for use with head-mounted displays.

BACKGROUND

Virtual-reality head-mounted displays have wide applications in various fields, including engineering design, medical surgery practice, military simulated practice, and video gaming. For example, a user wears a virtual-reality head-mounted display integrated with audio headphones while playing video games so that the user can have an interactive experience in an immersive virtual environment. It may be difficult, however, for a user to properly adjust and comfortably wear the head-mounted displays and the integrated audio systems using the existing technology, which may negatively affect the user's experience.

BRIEF DESCRIPTION OF THE DRAWINGS

For a better understanding of the various described embodiments, reference should be made to the Detailed Description below, in conjunction with the following drawings. Like reference numerals refer to corresponding parts throughout the figures and descriptions.

DETAILED DESCRIPTION

Overview

An earbud assembly with an overmolded seam cover is disclosed. The earbud assembly comprises first and second housing members that form an enclosure that houses an audio transducer. Flexible covers are overmolded onto the exterior surfaces of the housing members. The flexible covers each include an edge portion along their perimeters, and the edge portions tightly abut each other, thereby providing a smooth, contoured exterior outer surface that covers the seam formed at the junction between the housing members.

General Description

Many of the details and features shown in the Figures are merely illustrative of particular embodiments of the technology. Accordingly, other embodiments can have other details and features without departing from the spirit and scope of the present technology. In addition, those of ordinary skill in the art will understand that further embodiments can be practiced without several of the details described below. Furthermore, various embodiments of the technology can include structures other than those illustrated in the Figures and are expressly not limited to the structures shown in the Figures. Moreover, the various elements and features illustrated in the Figures may not be drawn to scale.

In the Figures, identical reference numbers identify identical or at least generally similar elements. To facilitate the description of any particular element, the most significant digit or digits of any reference number refer to the Figure in which that element is first introduced. For example, element 110 is first introduced and described with reference to FIG. 1.

Figure 1:
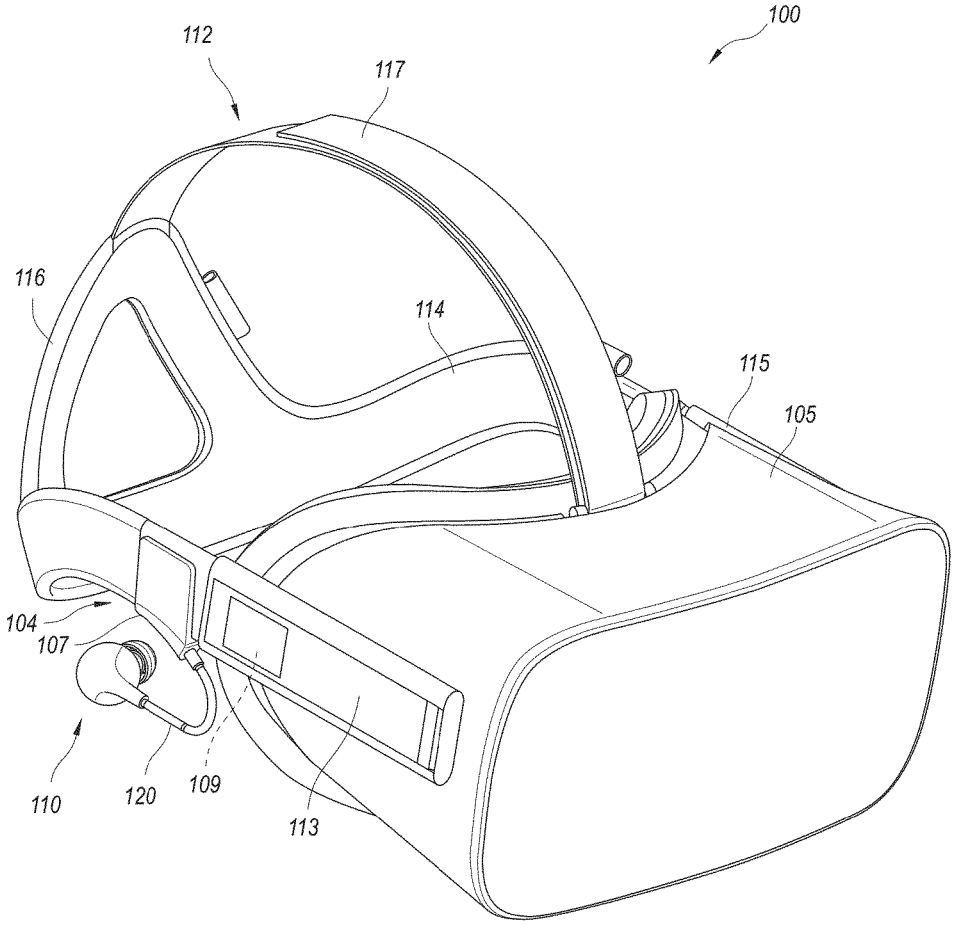
FIG. 1 is an isometric view of an earbud assembly incorporated into a head-mounted display system in accordance with an embodiment of the present disclosure.

FIG. 1 is an isometric view of an earbud assembly 110 ("earbud 110"). In the illustrated embodiment, the earbud 110 is operably coupled to a head mounted display 105 of a head-mounted display system 100. However, earbud assemblies configured in accordance with the various embodiments of the technology can be used with other types of electronic devices and systems, such as mp3 players, smart phones, laptop computers, televisions, and other audio and/or audio and video devices.

The head-mounted display system 100 comprises a strap 112 for mounting the head-mounted display 105 on a user's head. In the example of FIG. 1, the strap 112 comprises a rigid segment 113, a semi-rigid segment 114, and a rigid segment 115 that are coupled to each other to adjustably wrap around side and back portions of the user's head. In some embodiments, the strap 112 has a back piece 116 coupled with the semi-rigid segment 114 to rest against the back of the user's head (e.g., around the user's occipital lobe). In some embodiments, the strap 112 can have a top strap 117 coupled to the back piece 116 and the head-mounted display 105 to adjustably conform to the top of the user's head when the user is wearing the head-mounted display 105.

Each of the side segments 113 and 115 has electrical lines 109 (e.g., wires), such as flat flexible circuits, configured to operably connect the head-mounted display 105 to the earbud wire 120, and hence, the earbud 110. Although not shown due to the perspective, the head-mounted system 100 may have two earbuds 110 located on left and right sides to provide audio signals to the user's left and right ears. The left and right earbud 110 can be substantially symmetric and may use substantially symmetric structures for coupling the earbud 110 to a corresponding rigid segment of the strap 112.

The earbud 110 is operably coupled to the head-mounted display 105 via a flexible audio line or cable, such as a shielded earbud wire 120. In the illustrated embodiment, the earbud 110 and the earbud wire 120 are detachably coupled to the head mounted display 105 with a coupling subsystem 104 on each of the side segments 113 and 115. Each coupling subsystem 104 has a connection interface plate 107 mounted to the respective side segment 113/115 and operatively connected to the electrical lines 109 in the side segment. In some embodiments, the coupling subsystem includes a coupling subsystem described in U.S. Patent Application No. 62/273,358, title DETACHABLE AUDIO SYSTEM FOR HEAD-MOUNTED DISPLAY, filed on Dec. 30, 2015, which is incorporated herein by reference in its entirety. In other embodiments, the earbud wire 120 can be operably connected via an audio jack (e.g., 3.5 mm jack) that can be inserted into a corresponding audio receptacle.

Figure 2A:
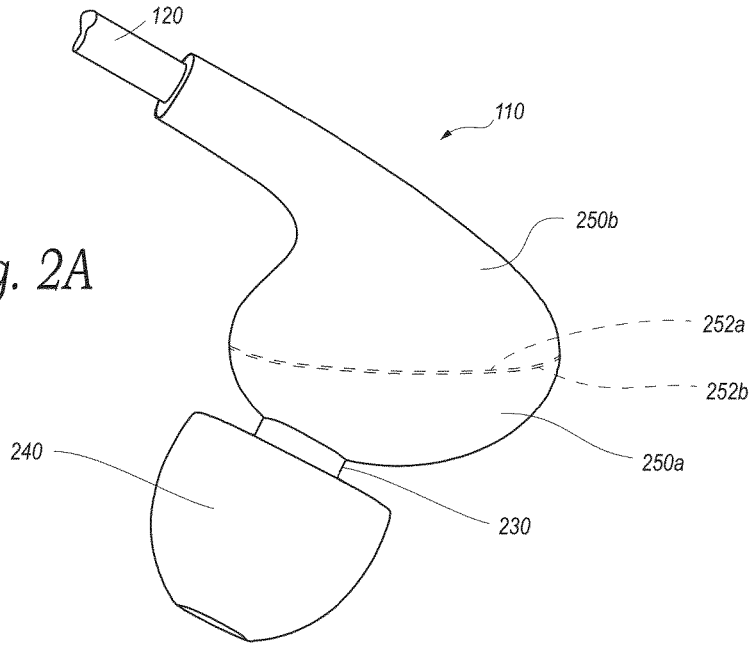
FIG. 2A is an enlarged isometric view.
Figure 2B:
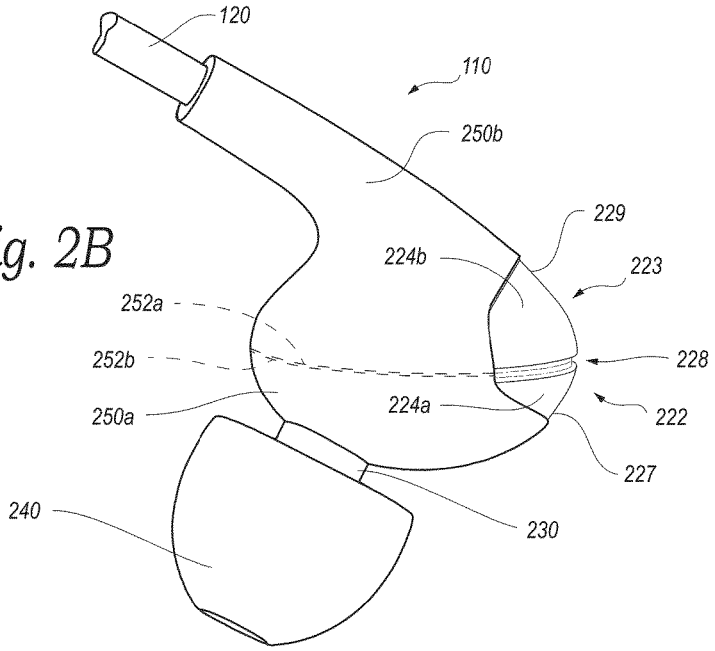
FIG. 2B is an enlarged cutaway view of the earbud assembly in accordance with an embodiment of the present disclosure.

FIG. 2A is an enlarged isometric view, and FIG. 2B is an enlarged cutaway view of the earbud 110. Referring to FIG. 2B, the earbud 110 has a contoured housing comprising a first housing member 222 attached to a second housing member 223. The first housing member 222 includes a hollow and generally semi-spherical shaped base portion 227 and an ear tube 230 projecting therefrom. The ear tube 230 of the first housing member 222 carries a removable, soft, flexible tip portion 240 configured to snugly fit into the user's ear. The second housing member 223 includes a rounded, contoured base portion 229 that securely mates with the base portion 227 to define an enclosure.

The base portion 227 of the first housing member 222 includes an exterior surface 224*a* that is at least partially covered by a smooth, flexible cover, or first overmold 250*a*. The base portion 229 of the second housing member 223 includes an exterior surface 224*b* that is at least partially covered by another smooth, flexible cover, or second overmold 250*b*. A portion of the second overmold 250*b* also encases a portion of the earbud wire 120 adjacent the second housing member 223, such that the overmold interface provides a flexible strain relief for the earbud wire.

The first overmold 250*a* terminates at a first edge portion 252*a*, or first lip 252*a* (shown in hidden lines) located along a perimeter of the first overmold 250*a*. The second overmold 250*b* terminates at a second edge portion, or second lip 252*b* (shown in hidden lines) along the perimeter of the second overmold 250*b*, where it abuts the first lip 252*a* of the first overmold 250*a*. In one embodiment described in greater detail below, the first and second lips 252*a-b* are configured to fully cover outer edges of a seam located at a junction 228 between the housing members 222 and 223, which results in a smooth, soft, durable exterior of the earbud 110 that enhances user comfort and/or virtually conceal the visual appearance of the seam on the earbud 110.

Figure 3A:
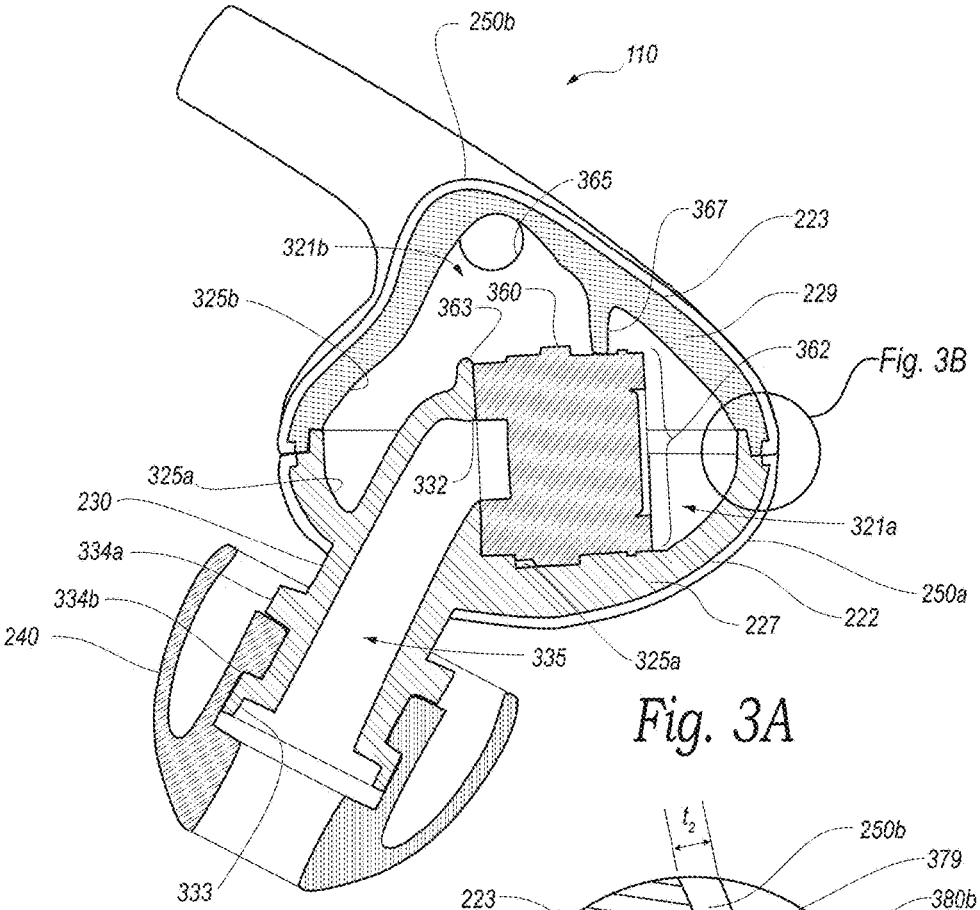
FIG. 3A is a cross-sectional view illustrating the earbud assembly in further detail.
Figure 3B:
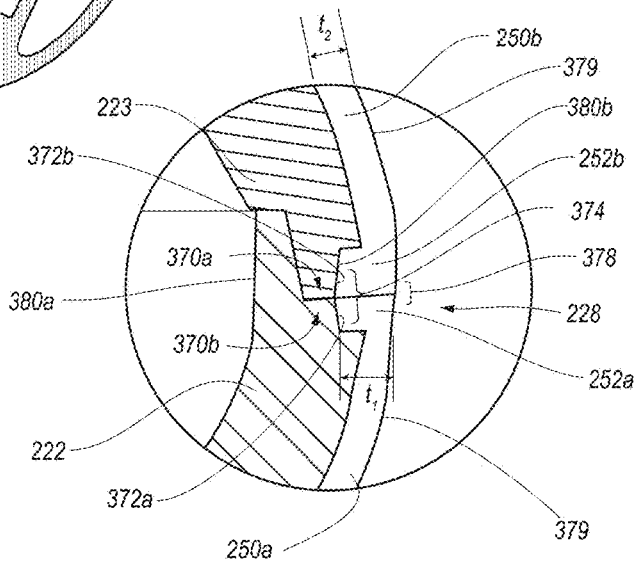
FIG. 3B is an enlarged cross-sectional view of a portion of the earbud assembly taken from FIG. 3A.

FIG. 3A is a cross-sectional view illustrating the earbud 110 in further detail, and FIG. 3B is an enlarged cross-sectional view of a portion of the earbud 110 taken from FIG. 3A. Referring to FIG. 3A, the first housing member 222 includes an interior surface 325*a* defining a first cavity 321*a* in the base portion 227. The second housing member 223 includes an interior surface 325*b* defining a second cavity 321*b* in the base portion 229. The first and second cavities 321*a-b* together form an enclosure configured to house and mechanically support an audio transducer 360 (e.g., a speaker) adjacent to the ear tube 230.

In the illustrated embodiment, the audio transducer 360 is seated on an integral transducer support 362 formed in the interior surface 325*a* of the first housing member 222. The transducer support 362 includes an abutment feature 363 that abuts a transducer-side of the audio transducer 360. The abutment feature 363 defines an opening 332 through which the transducer 360 transmits acoustic signals into a cavity 335 of the ear tube 230. The transducer support 362 can contact the audio transducer 360 on multiple sides to secure the transducer in a fixed position and in proper alignment with the internal opening 332 of the ear tube 230. In the illustrated embodiment, a rib 367 projects from the base portion 229 of the second housing member 223 and inside the second cavity 321*b* to contact and thereby firmly secure the audio transducer 360 within the enclosure of the earbud 110.

The audio transducer 360 is electrically coupled to an end portion of the earbud wire 120 (not shown in FIG. 3A) that is inserted through an aperture 365 in the second housing member 223 and into the enclosure of the earbud 110. In some embodiments, the end portion of the earbud wire 120 can be crimped with a ferrule within the earbud enclosure or otherwise secured to prevent the earbud wire 120 from pulling out of the enclosure and detaching from the audio transducer 360 during use.

In some embodiments, a thin, compliant membrane, such as a foam disc, can be installed in the internal opening 332 of the tube cavity 335 and/or between the abutment feature 363 and the audio transducer 360. The membrane can be configured to enhance sound quality and/or prevent or inhibit the ingress of dirt, debris, moisture, and/or other contaminants into the enclosure. A thin membrane can also be positioned in or near an exterior opening 333 of the ear tube 230 at the opposite end of the tube cavity 335. The ear tube 230 can include flange portions 334*a-b* configured to secure the flexible tip portion 240 to the body of the ear tube 230 in a conventional manner.

Referring to FIG. 3B, the first housing member 222 includes an outer rim, or first outer edge 370*a*, located at the junction 228 with the second housing member 223. The second housing member 223 includes an outer rim, or a second outer edge 370*b*, that abuts the first outer edge 370*a*, thereby forming a seam 374 between the housing members 222 and 223. In the illustrated embodiment, the first outer edge 370*a* is adjacent a first recess 372*a* formed in the first housing member 222, and the second outer edge 370*b* is adjacent a second recess 372*b* formed in the second housing member 223. The flexible overmold lips 252*a-b* extend into and abut one another within the corresponding recesses 372*a-b*, such that the interconnected, smooth overmold 250*a-b* fully covers and hides the seam 374 between the housing members 222 and 223.

The housing members 222 and 223 are each formed from a generally rigid material, such as hard plastic (e.g., a thermoplastic), and the overlying flexible overmolds 250*a-b* each comprise a durable, relatively softer material, such as a soft-touch rubber overmold material. In one embodiment, the housing members 222 and 223 can be formed from acrylonitrile butadiene styrene (ABS), and the flexible overmolds 250*a-b* can be formed from silicone rubber. In embodiments described below, the housing members 222 and 223 are formed from injected molded plastic which is then overmolded with the corresponding flexible soft material of the overmolds 250*a-b* in a subsequent molding stage.

In general, it is difficult to eliminate seams between injection-molded parts, especially for parts with small and precise geometries due to e.g., process variability, limited dimensional tolerances of mold tooling, and/or degradation of a mold over its life cycle. A related challenge is that the seams between molded parts can form abrupt edges or severe surface transitions between the abutting parts. In the case of earbuds and related assemblies, an abrupt edge may cause discomfort to the user when the edge brushes across the outer and/or inward areas of the ear, such as when the user adjusts or installs an earbud within the ear. Another drawback of seams between molded earbud components is that seams can sometimes form ingress paths that allows dirt, debris, moisture, and/or other contaminants to enter into the interior of the earbud enclosure.

In one aspect of the technology, the flexible lips 252*a-b* of the corresponding flexile overmolds 250*a-b* can cover the outer edges 370*a-b* and/or other edges of the housing members 222 and 223 near the seam 374. For example, a portion of the first lip 252*a* can extend up to and/or beyond the first outer edge 370*a* of the first housing member 222, and the second lip 252*b* can likewise extend up to and/or beyond the second outer edge 370*b* of the second housing member 223. In use, the relatively soft material of the overmold lips 252*a-b* can protect the user from discomfort that might otherwise occur when relatively rigid and abrupt plastic edges brush against the outer and inward areas of the wearer's ear during use.

In another aspect of this embodiment, the overmold lips 252*a-b*, due to the flexible properties of the overmold material, can slightly deform when pressed into contact with one another and thereby form a compressive fit. For example, the second lip 252*b* can press the first lip 252*a* into the first recess 372*a* during attachment of the housing members 222 and 223. The first lip 252*a* can likewise press the second lip 252*b* into the second recess 372*b*. In a related aspect, the overmold lips 252*a-b* can form a compressive seal that prevent ingress of dirt, debris, moisture, or other contaminants into the earbud enclosure, such as through any localized gaps that may exists between the outer edges 370*a-b* of the housing members 222 and 223. In some embodiments, the compressive fit of the overmold lips 252*a-b* can form a seam 378 between the flexible overmolds 250*a-b* that is invisible or virtually invisible to the user. Accordingly, in such embodiments, the overmolds 250*a-b* can give a visual appearance of an earbud having a continuous exterior surface 379 without any seam between the overmolds 250*a-b*, nor any seam between the housing members 222 and 223.

In the illustrated embodiment shown in FIG. 3B, each of the overmold lips 252*a-b* has a thickness $t_1$ corresponding to the depth of the corresponding recess 372*a-b*. In this embodiment, the thickness $t_1$ of the overmold lips 252*a-b* is greater than a thickness $t_2$ of the portions of the corresponding overmolds 250*a-b* located outside of the recesses 372*a-b*. In another embodiment, the overmold lips 250*a-b* can have a generally constant thickness.

The first housing member 222 further includes a first attachment structure 380*a* projecting at the first outer edge 370*a*. The second housing member 223 further includes a second attachment structure 380*b* configured to engage the first attachment structure 380*a* to facilitate attachment to the first housing members 222. In one embodiment described below, the attachment structures 380*a-b* can be sized and shaped to form an annular snap-fit. In additional or alternate embodiments, the surfaces of attachment structures 380*a-b* can be ultrasonically welded and/or bonded to one another via an adhesive. In general, the housing members 222 and 223 can be bonded while simultaneously pressing the first overmold lip 252*a* against the second overmold lip 252*b*. In some embodiments, attachment structures can include tabs, tongue-and-groove features, surface features (e.g., a continuous ring or dimple), and/or other features for facilitating attachment of the housing members 222 and 223.

Figure 4B:
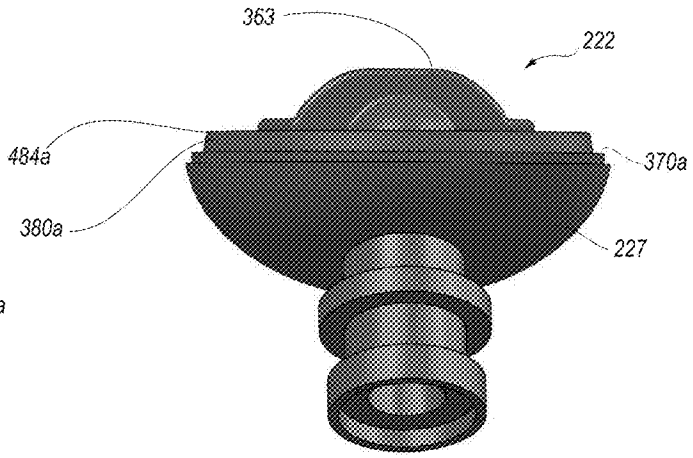
FIGS. 4A-4C are various isometric views showing a first housing member of the earbud assembly in accordance with an embodiment of the present disclosure.
Figure 4A:
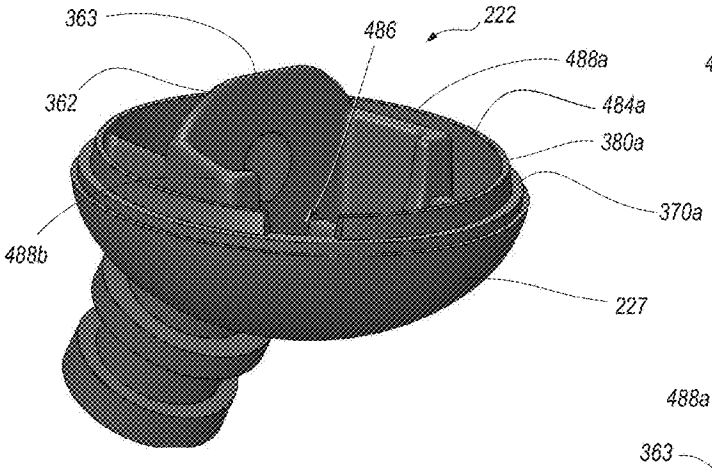
Figure 4C:
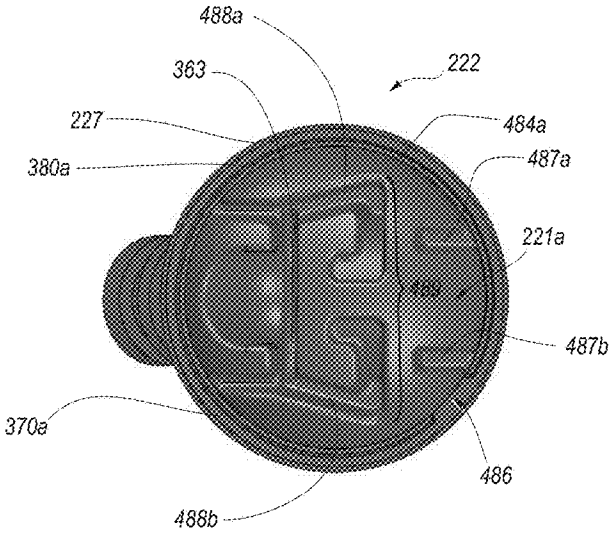

FIGS. 4A-4C are various isometric views showing the first housing member 222 with the first overmold 250*a* removed for purposes of illustration. Referring to FIGS. 4A-4C together, the first attachment feature 380*a* of the first housing member 222 includes a projection, or first annular wall 484, that projects from the base portion 227 and extends along the first outer edge 370*a*. The first annular wall 484 is discontinuous and includes a first locking feature 486 (e.g., a gap).

The transducer support 362 of the first housing member 222 includes a first pair of complementary inner wall portions 488*a-b* extending generally perpendicularly from the abutment feature 363. The inner wall portions 488*a-b* can curve inwardly toward one another to form a semi-circular saddle 489 (FIG. 4C) configured to cradle a portion of the audio transducer 360 (FIG. 3A). A second pair of parallel wall portions 487*a-b* can extend between the saddle 489 and a region in the first cavity 321*a* proximate the first outer edge 370*a* to provide further reinforcement to the audio transducer 360 when seated in the saddle 489.

Figure 5B:
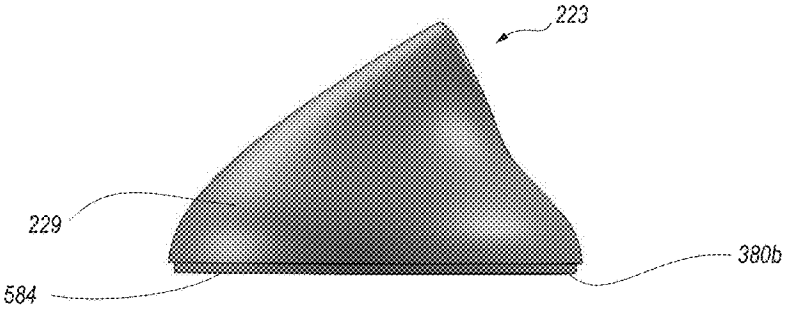
FIGS. 5A-5C are various isometric views showing a second housing member of the earbud assembly in accordance with an embodiment of the present disclosure.
Figure 5C:
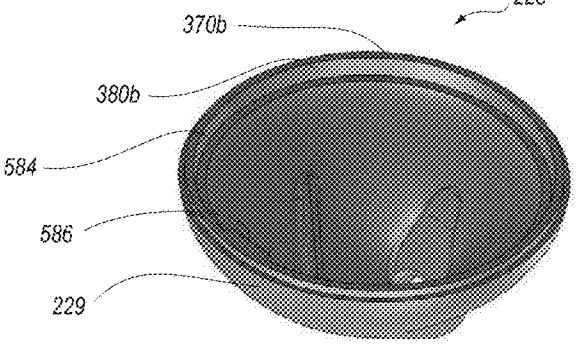
Figure 5A:
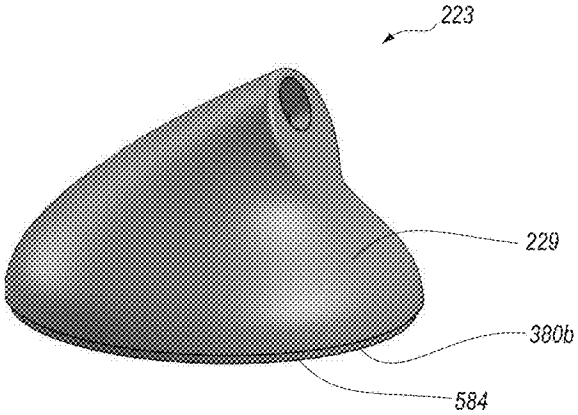

FIGS. 5A-5C are various isometric views showing the second housing member 223 with the second overmold 250*b* removed for purposes of illustration. Referring to FIGS. 5A-5C together, the second attachment feature 380*b* of the second housing member 223 includes a second projection, or second annular wall 584, that projects from the base portion 229 and defines the second outer edge 370*b*. The second annular wall 584 is similar in shape to the first annular wall 484 of the first attachment feature 380*a*, but has a larger diameter that allows the second annular wall 584 to overlap the first annular wall 484 when the housing members 222 and 223 are assembled. The second annular wall 584 is also continuous and includes a second locking feature 586 (e.g., a protrusion) that engages the first locking feature 486 (FIGS. 4A-4C) to restrict rotational movement between the housing members.

Figure 6A:
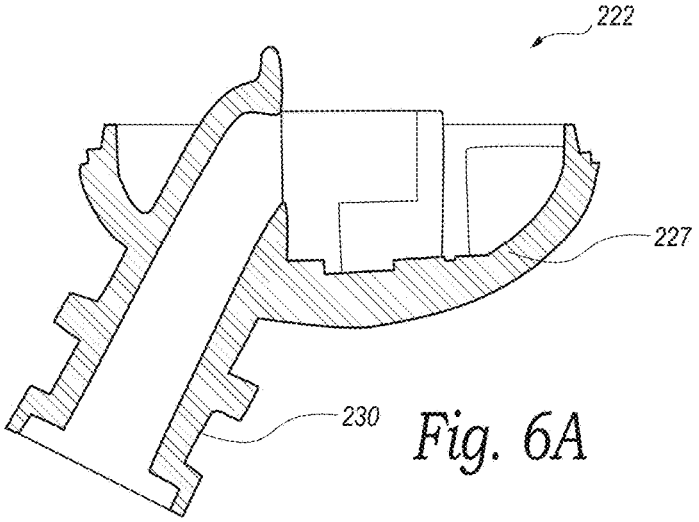
FIGS. 6A-6D are cross-sectional views illustrating components of the earbud assembly at various stages in a method for making an earbud assembly in accordance with embodiments of the present disclosure.
Figure 6B:
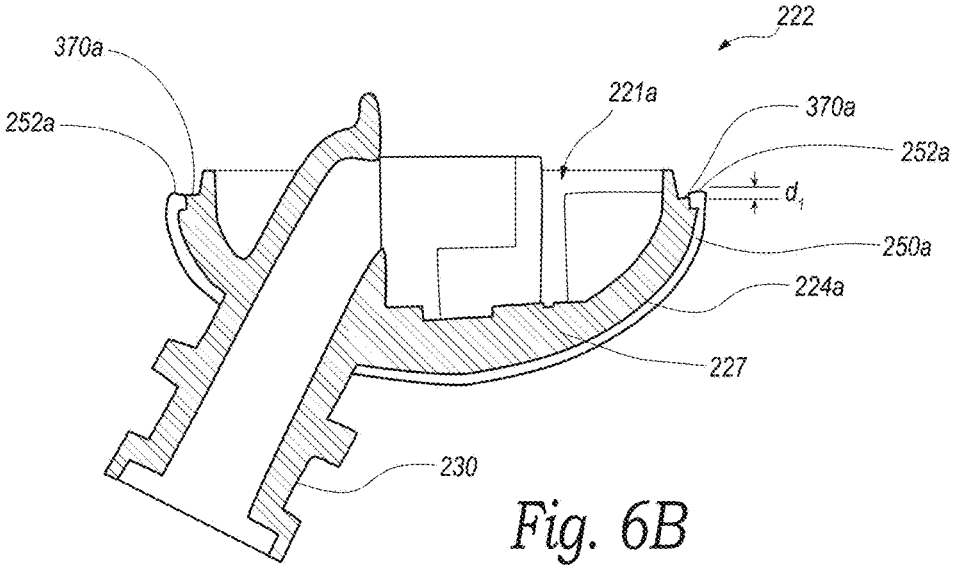

FIGS. 6A-6D are cross-sectional views illustrating components of the earbud 110 at various stages in a method for making an earbud assembly in accordance with embodiments of the present disclosure. FIG. 6A shows the first housing member 222 after an injection molding stage in which the features of the base portion 227 and the ear tube 230 have been formed. FIG. 6B shows the first housing member 222 after a molding stage in which the first overmold 250*a* is formed on selected portions of the first exterior surface 224*a*. In some embodiments, a primer can be applied to the exterior surface 224*a* or selected areas of the exterior surface to promote or initiate adhesion of the overmold material. The primer can include, for example, a catalyst that catalyzes the adhesion process. In other embodiments, other surface treatment techniques (e.g., plasma and corona treatment techniques) can be used to bond the overmold to the exterior surface of a housing member. In some embodiments, a "self-bonding" silicone or other self-bonding material can be attached to the exterior surface without the use of a primer and/or surface treatment. In these and other embodiments, the first housing member 222 can be placed in a mold to selectively cover certain portions of the first housing member 222 that are not to be covered by the first overmold 250*a*, such as the inner surface of the cavity 221*a* and the exterior surface of the ear tube 230. In certain embodiments, the first housing member 222 and the corresponding overmold 250*a* can be formed using a "two-shot" molding process in which the same mold is used to first form the first housing member 222 and the corresponding overmold 250*a* without having to remove the mold during the sequence of molding stages. In one embodiment, the first overmold lip 252*a* can slightly project a distance $d_1$ beyond the first outer edge 370*a* of the first housing member 222 to ensure that a compressive fit is formed when the first overmold lip 252*a* contacts the second overmold lip 252*b* during attachment. In another embodiment, the first overmold lip 252*a* can be flush with the first outer edge 370*a*.

Figure 6C:
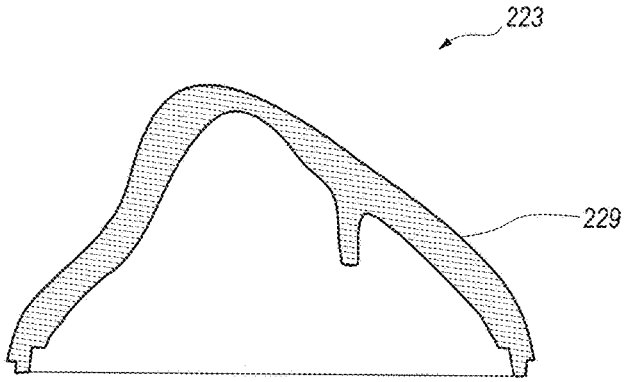
Figure 6D:
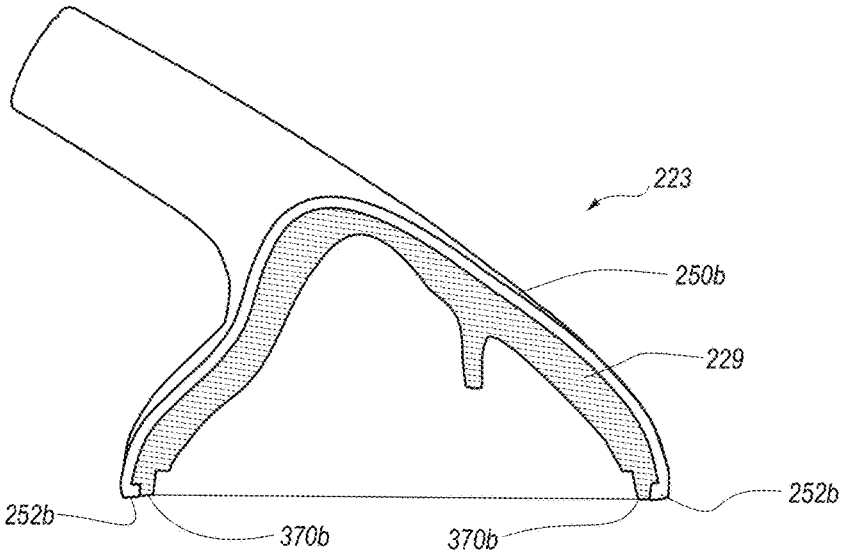

FIG. 6C shows the second housing member 223 after an injection molding stage in which the features of the base portion 229 have been formed. FIG. 6D shows the second housing member 223 after a molding stage in which the second overmold 250*b* is formed on selected portions of the second exterior surface 224*b*. The molding stages of FIGS. 6C and 6D can be substantially similar to the molding stages of FIGS. 6A and 6B, but use a different mold to form the shape of the second housing member 223 and the corresponding overmold 250*b*. The second lip 252*b* of the second overmold 250*b* can be configured to project slightly beyond the second outer edge 370*b*, or it can be flush with the second outer edge 370*b* (as shown). Once formed and coated with the overmold, the first and second housing members 222 and 223 can be attached to one another via the attachment structures 380*a-b*, as discussed above.

In the illustrated embodiments, the earbud 110 has a shape configured to conform or at least partially conform to the anatomy (e.g., the inner conch) of a user's ear to enhance comfort and fit and/or to orient the earbud wire. While only earbud assembly is described above, it is to be understood that an earbud assembly can have a shape corresponding to user's left ear or right ear. In some embodiments, left and right earbuds can have the same, universal shape.

The foregoing description, for purpose of explanation, has been described with reference to specific embodiments. However, the illustrative discussions above are not intended to be exhaustive or to limit the scope of the claims to the precise forms disclosed. Many modifications and variations are possible in view of the above teachings. The embodiments were chosen in order to best explain the principles underlying the claims and their practical applications, to thereby enable others skilled in the art to best use the embodiments with various modifications as are suited to the particular uses contemplated.

We claim:

1. An earbud assembly, comprising:

a first housing member having a first exterior surface and a first outer edge;

a second housing member attached to the first housing member, the second housing member having a second exterior surface and forming an enclosure with the first housing member that houses an audio transducer, the second housing member having a second outer edge adjacent the first outer edge to form a seam between the first and second housing members, and the enclosure having a recess adjacent the seam;

a first flexible cover on the first exterior surface of the first housing member; and a second flexible cover on the second exterior surface of the second housing member, wherein the first flexible cover includes a first perimeter and a first edge portion along the first perimeter and a portion of the first perimeter is in the recess, and the second flexible cover includes a second perimeter and a second edge portion along the second perimeter and a second edge portion along the second perimeter is in the recess, and wherein the first edge portion is configured to abut the second edge portion in a compressive fit in the recess and at least partially cover the seam between the first and second housing members.

2. The earbud assembly of claim 1 wherein:

the first housing member includes a first portion of the recess adjacent the seam;

the second housing member includes a second portion of the recess adjacent the first portion of the recess;

the first edge portion extends into the first portion of the recess; and the second edge portion extends into the second portion of the recess.

3. The earbud assembly of claim 1 wherein the first housing member includes a first portion of the recess adjacent the seam, and wherein the first edge portion of the first flexible cover extends into the first portion of the recess.

4. The earbud assembly of claim 3 wherein the first edge portion has a first thickness in the first portion of the recess, and wherein the first flexible cover has a second thickness less than the first thickness outside of the recess.

5. The earbud assembly of claim 1, wherein the first housing member further includes an attachment feature adjacent the recess and configured to attach the first housing member to the second housing member.

6. The earbud assembly of claim 5 wherein the attachment feature is bonded to the second housing member beneath the first and second edge portions of the corresponding first and second flexible covers.

7. An earbud assembly, comprising:

a housing having a first housing member with a first outer edge and a second housing member with a second outer edge attached to the first outer edge, wherein the housing has an annular recess and the first and second outer edges form a seam adjacent the annular recess, and wherein an audio transducer is at least partially enclosed within the housing;

a first overmold formed over the first housing member and terminating at a first lip proximate the first outer edge of the first housing member, wherein at least a portion of the first lip is in the annular recess; and a second overmold formed over the second housing member and terminating at a second lip proximate the second outer edge of the second housing member, wherein at least a portion of the second lip is in the annular recess and wherein the second lip abuts the first lip at the annular recess in a compression fit.

8. The earbud assembly of claim 7 wherein portions of the annular recess are formed in the first and second housing members adjacent the first and second outer edges.

9. The earbud assembly of claim 7 wherein the housing comprises an injection-molded plastic, and wherein each of the first and second overmolds comprises silicone rubber.

10. A method of manufacturing an earbud assembly, the method comprising:

forming a first flexible cover over an exterior surface of a first housing member;

forming a second flexible cover over an exterior surface of a second housing member; and attaching the second housing member to the first housing member to form an enclosure around an audio transducer, wherein the enclosure has an annular recess at a junction between the first and second housing members and wherein attaching the second housing member includes pressing a first edge portion of the first flexible cover into contact with a second edge portion of the second flexible cover in a compression fit and at least partially within the annular recess to cover a seam.

11. The method of claim 10 wherein portions of the annular recess proximate the seam are formed in the first and second housing members adjacent the first and second edge portions.

12. The method of claim 10 wherein attaching the second housing member to the first housing member includes bonding the second housing member to the first housing member while pressing the first edge portion of the first flexible cover into contact with the second edge portion of the second flexible cover.

13. The method of claim 10 wherein the first housing member includes a first outer edge that defines the seam with a second outer edge of the second housing member, and wherein forming the first flexible cover includes forming the first edge portion of the first flexible cover flush with the first outer edge of the first housing member.

14. The method of claim 10 wherein the first housing member includes a first outer edge that defines the seam with a second outer edge of the second housing member, and wherein forming the first flexible cover includes forming the first edge portion of the first flexible cover such that the first edge portion projects beyond the first outer edge of the first housing member.

15. The method of claim 10 wherein forming the first and second flexible covers includes overmolding silicon rubber onto the corresponding first and second housing members.

* * * * *